US009156047B2

(12) United States Patent
Wang

(10) Patent No.: US 9,156,047 B2
(45) Date of Patent: Oct. 13, 2015

(54) CONTAINER INCLUDING A DEPRESSIBLE HEAD ASSEMBLY

(71) Applicant: Well Max Beauty Lab Co., Ltd., Tainan (TW)

(72) Inventor: Teng-Huei Wang, Tainan (TW)

(73) Assignee: Well Max Beauty Lab Co., Ltd., Tainan (TW)

( * ) Notice: Subject to any disclaimer, the term of this patent is extended or adjusted under 35 U.S.C. 154(b) by 29 days.

(21) Appl. No.: 14/093,839

(22) Filed: Dec. 2, 2013

(65) Prior Publication Data

US 2014/0209636 A1 Jul. 31, 2014

(51) Int. Cl.
*B67D 1/00* (2006.01)
*B05B 11/00* (2006.01)

(52) U.S. Cl.
CPC ..... *B05B 11/3002* (2013.01); *B05B 11/3008* (2013.01); *B05B 11/3023* (2013.01); *B05B 11/3074* (2013.01)

(58) Field of Classification Search
CPC ..... B05B 11/3059; B05B 11/3023; B05B 11/306
USPC ..... 222/15, 153.13, 153.14
See application file for complete search history.

(56) References Cited

U.S. PATENT DOCUMENTS

| | | | | |
|---|---|---|---|---|
| 4,991,746 | A * | 2/1991 | Schultz | 222/153.13 |
| 5,615,806 | A * | 4/1997 | Grothoff | 222/153.13 |
| 5,899,363 | A * | 5/1999 | Bliss et al. | 222/153.02 |
| 6,164,498 | A * | 12/2000 | Faughey et al. | 222/309 |
| 7,802,701 | B2 * | 9/2010 | Jahan et al. | 222/153.13 |
| 2005/0155986 | A1 * | 7/2005 | Mizukawa et al. | 222/148 |
| 2008/0251537 | A1 * | 10/2008 | Kuo | 222/153.13 |
| 2012/0305604 | A1 * | 12/2012 | Wang | 222/321.9 |
| 2013/0200106 | A1 * | 8/2013 | Kang | 222/153.13 |

* cited by examiner

*Primary Examiner* — Paul R Durand
*Assistant Examiner* — Jeremy W Carroll
(74) *Attorney, Agent, or Firm* — Krieg DeVault LLP

(57) ABSTRACT

A container includes a container body for receiving a liquid, a locking connector, a pump unit and a depressible head assembly. The locking connector includes a locking ring threadedly disposed on a top portion of the container body, a dosage guide ring protruding upwardly from the locking ring, and at least one dosage guide unit. The pump unit extends downwardly into the container body and is drivenable to move in a top-bottom direction so as to draw the liquid in the container body. The depressible head assembly includes a depressible head for driving the pump unit to move in the top-bottom direction, and a biasing member abutting against the depressible head and the locking connector.

15 Claims, 8 Drawing Sheets

CONTAINER INCLUDING A DEPRESSIBLE HEAD ASSEMBLY

CROSS-REFERENCE TO RELATED APPLICATION

This application claims priority of Taiwanese application no. 102201827, filed on Jan. 28, 2013.

BACKGROUND OF THE INVENTION

1. Field of the Invention

The invention relates to a container, more particularly to a container including a depressible head assembly.

2. Description of the Related Art

A skincare solution is generally received in a container with a depressible head so as to conveniently draw the skincare solution by depressing the depressible head. However, the conventional container with the depressible head is unable to quantitatively draw the skincare solution. When a user intends to have access to the skincare solution received in the conventional container with the depressible head, he or she has to carefully control the extent of depression of the depressible head so as to obtain the desired amount of the skincare solution. However, it is quite often to draw an excessive or insufficient amount. Thus, there is still a need for further improvement on quantitatively controlling the amount to be drawn of the content received in a container with a depressible head.

SUMMARY OF THE INVENTION

Therefore, an object of the present invention is to provide a container that can alleviate the aforesaid drawback of the prior art.

Accordingly, the container of the present invention includes:

a container body;

a locking connector threadedly disposed on the container body, the locking connector including a locking ring threadedly disposed on a top portion of the container body, a dosage guide ring that protrudes outwardly of an inner peripheral edge of the locking ring, and at least one dosage guide unit that is indented from a top end of the dosage guide ring and that has a plurality of dosage guide grooves, which are downwardly and separately indented from the top end of the dosage guide ring to different depths in a top-bottom direction;

a pump unit extending through and being mounted in the dosage guide ring, the pump unit extending downwardly into the container body and being drivenable to move upwardly and downwardly in the top-bottom direction so as to draw a liquid received in the container body; and a depressible head assembly including a depressible head that is disposed between the pump unit and the dosage guide ring for driving the pump unit to move upwardly and downwardly in the top-bottom direction, and a biasing member that abuts against the depressible head upwardly with respect to the locking connector, the depressible head being formed with a dispensing port for dispensing the liquid drawn by the pump unit and having an alignment rib portion that is movable in the top-bottom direction and that is insertable into one of the dosage guide grooves, the depressible head being drivenable to rotate with respect to the locking connector between a locked position, where the alignment rib portion abuts against the dosage guide ring and is thereby limited from being pressed downwardly to an extent as to drive the pump unit, and a depressible position, where the alignment rib portion is aligned with one of the dosage guide grooves and is depressible downwardly to drive the pump unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
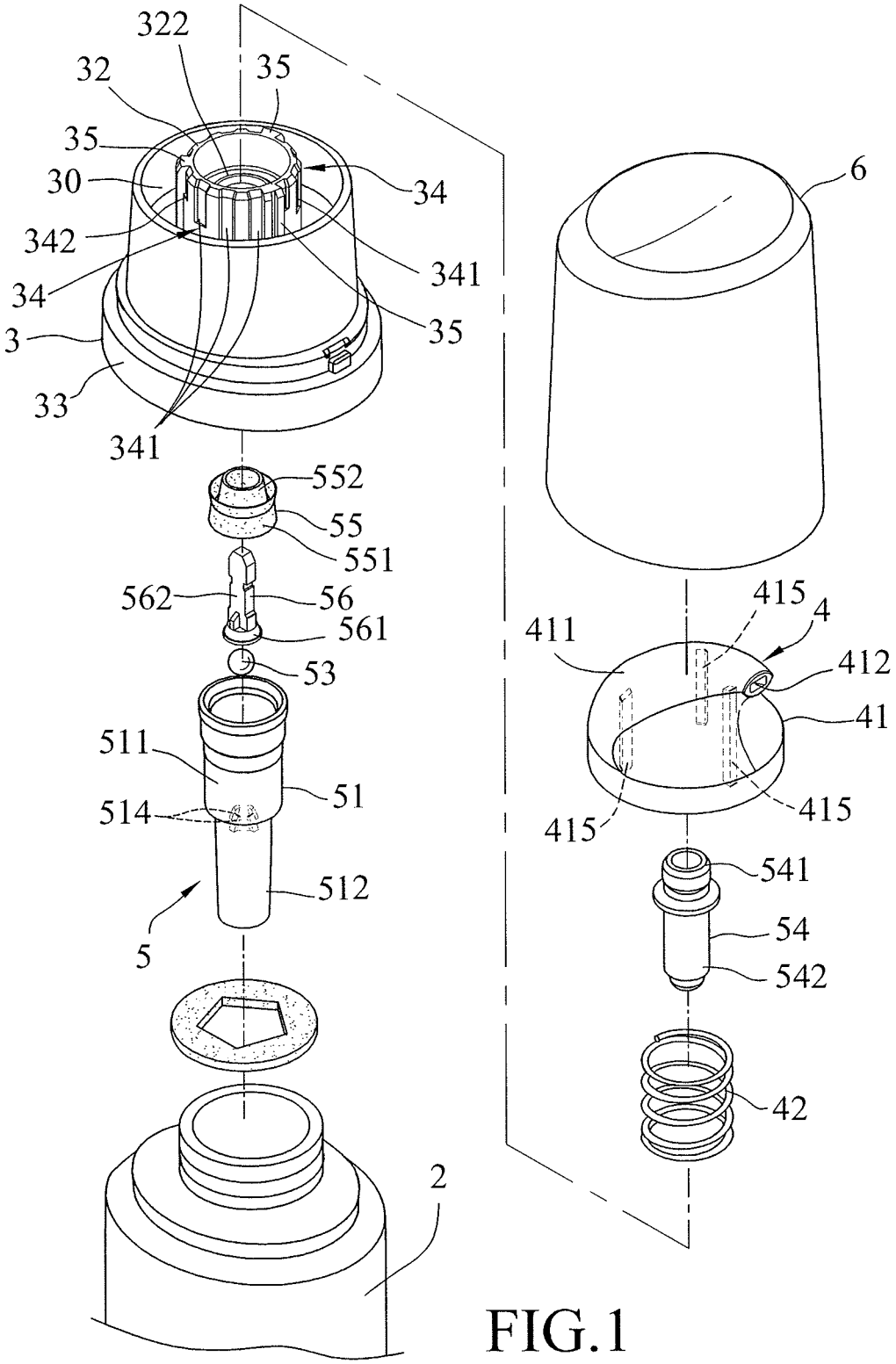
FIG. 1 is a fragmentary exploded perspective view of the preferred embodiment of a container with a depressible head assembly according to the present invention.
Figure 2:
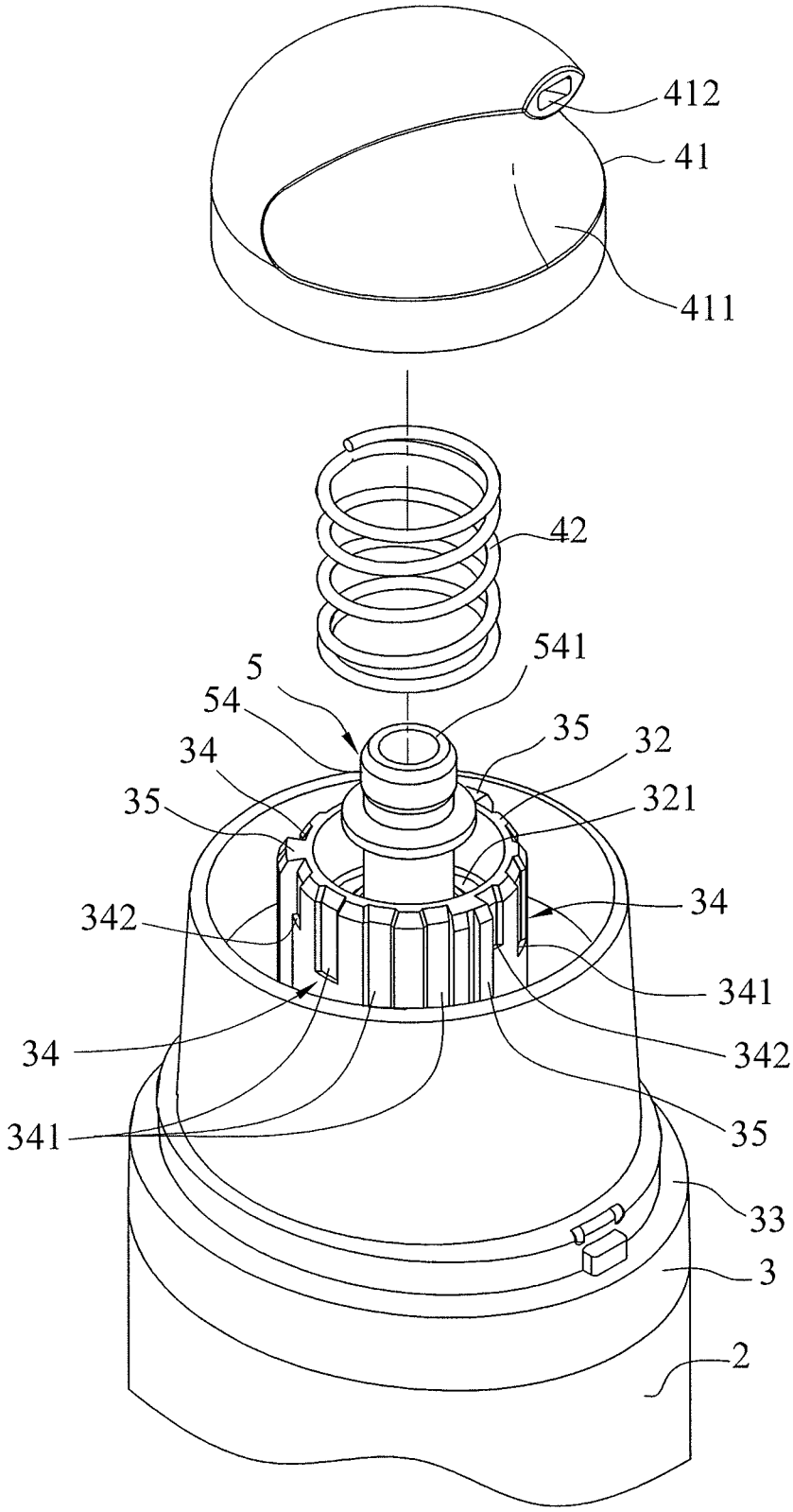
FIG. 2 is another fragmentarily exploded perspective view of the preferred embodiment.
Figure 3:
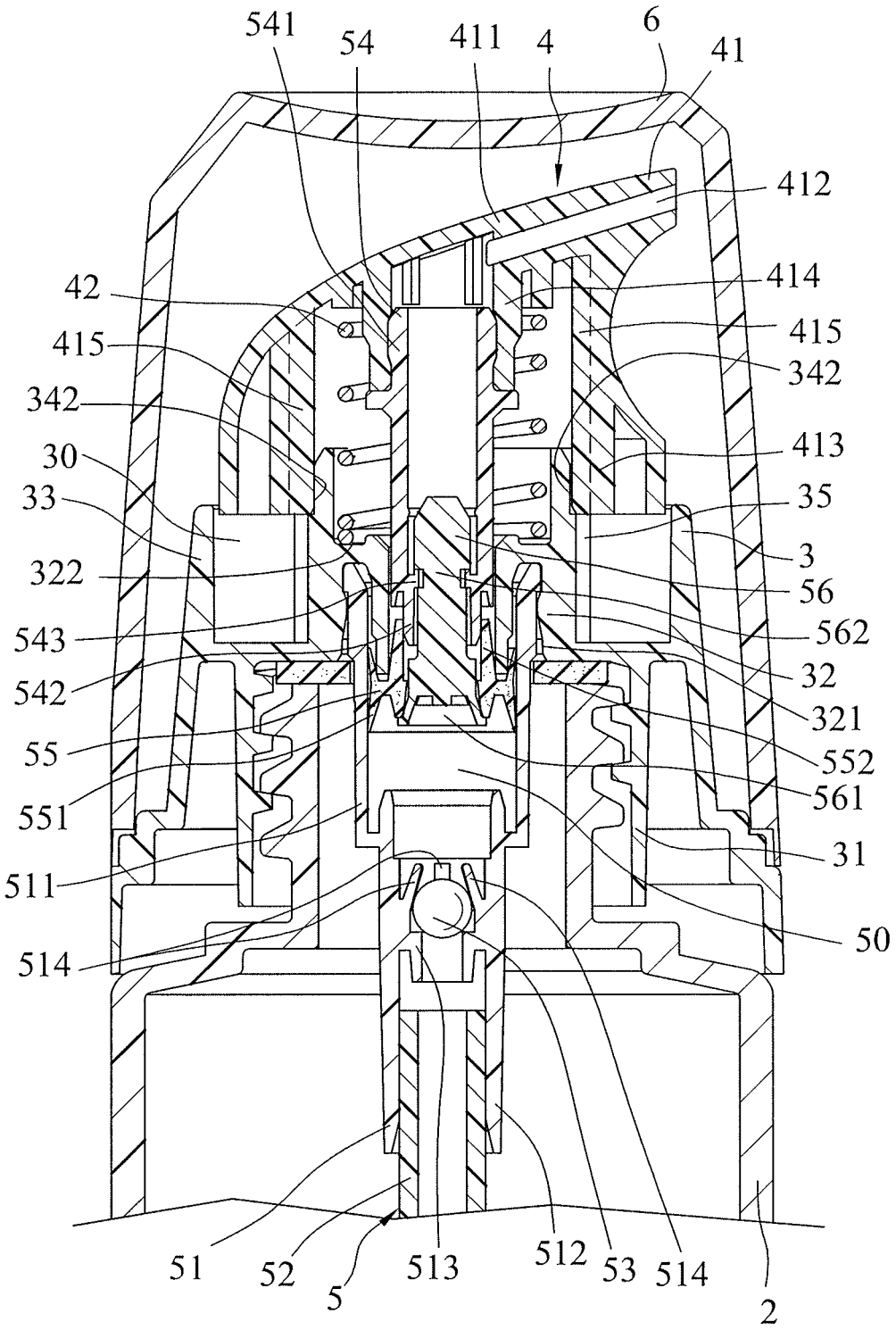
FIG. 3 is a fragmentary sectional view of the preferred embodiment.

Referring to FIGS. 1 to 3, the preferred embodiment of a container with a depressible head assembly according to this invention is adapted to receive a liquid and to dispense the liquid in a multistage manner. The container includes: a container body 2 that is formed with a top opening for receiving a liquid; a locking connector 3 that is threadedly disposed on the container body 2; a depressible head assembly 4 that is resiliently and downwardly depressible and that is rotatably mounted on the locking connector 3; a pump unit 5 that extends through the depressible head assembly 4 and the locking connector 3, that is mounted in the locking connector 3 and that extends downwardly into the container body 2; and a cap 6 that is mounted on the locking connector 3 and that covers the depressible head assembly 4.

The locking connector 3 includes a locking ring 31 that is threadedly disposed on a top portion of the container body 2, a dosage guide ring 32 that protrudes outwardly of the locking ring 31, an outer surrounding ring 33 that extends in a top-bottom direction from an outer peripheral edge of the locking ring 31, three dosage guide units 34 that are angularly spaced-apart and axially indented from a top end of the dosage guide ring 32, and three spaced-apart blocking ribs 35 that protrude from the dosage guide ring 32 and that extend in the top-bottom direction. Each of the blocking ribs 35 which is disposed between two corresponding adjacent ones of the dosage guide units 34. The locking ring 31, the dosage guide ring 32 and the outer surrounding ring 33 cooperate to define a mounting space 30 having a top opening.

The dosage guide ring 32 has a bottom side formed with an annular engaging groove 321 and has an abutting surface 322 that radially and inwardly extends toward the pumping unit 5. Each dosage guide unit 34 has three dosage guide grooves 341 that are downwardly and separately indented from the top end of the dosage guide ring 32 to different depths in the top-bottom direction and a limiting groove 342 that is indented from the top end of the dosage guide ring 32. Each of the dosage guide grooves 341 and the limiting grooves 342 has a cross section that is perpendicular to the top-bottom direction and that is outwardly and radially diverged. The limiting grooves 342 are smaller in depth than the dosage guide grooves 341.

The depressible head assembly 4 includes a depressible head 41 that is disposed on the locking connector 3 and movable in the top-bottom direction so as to drive the pump unit 5 to move in the top-bottom direction, and a biasing member 42, such as a spring, that is disposed between and abuts against the abutting surface 322 of the dosage guide ring 32 of the locking connector 3 and the depressible head 41 in the top-bottom direction. The depressible head 41 is made of an elastic plastic material and includes a depressible head body 411 that has a bottom opening and that is depressible downwardly to move into the mounting space 30, an inner surrounding ring 413 that protrudes downwardly from an inner surface of the depressible head body 411 to be sleeved on the dosage guide ring 32, an engaging ring 414 that protrudes downwardly from the inner surface of the depressible head body 41 and that is movably sleeved on the pumping unit 5, and three alignment rib portions 415 that protrude from an inner peripheral surface of the inner surrounding ring 413, that extend in the top-bottom direction and that are respectively engaged with the dosage guide units 34. The depressible head 41 is formed with a dispensing port 412 for dispensing the liquid drawn by the pumping unit 5.

Figure 4:
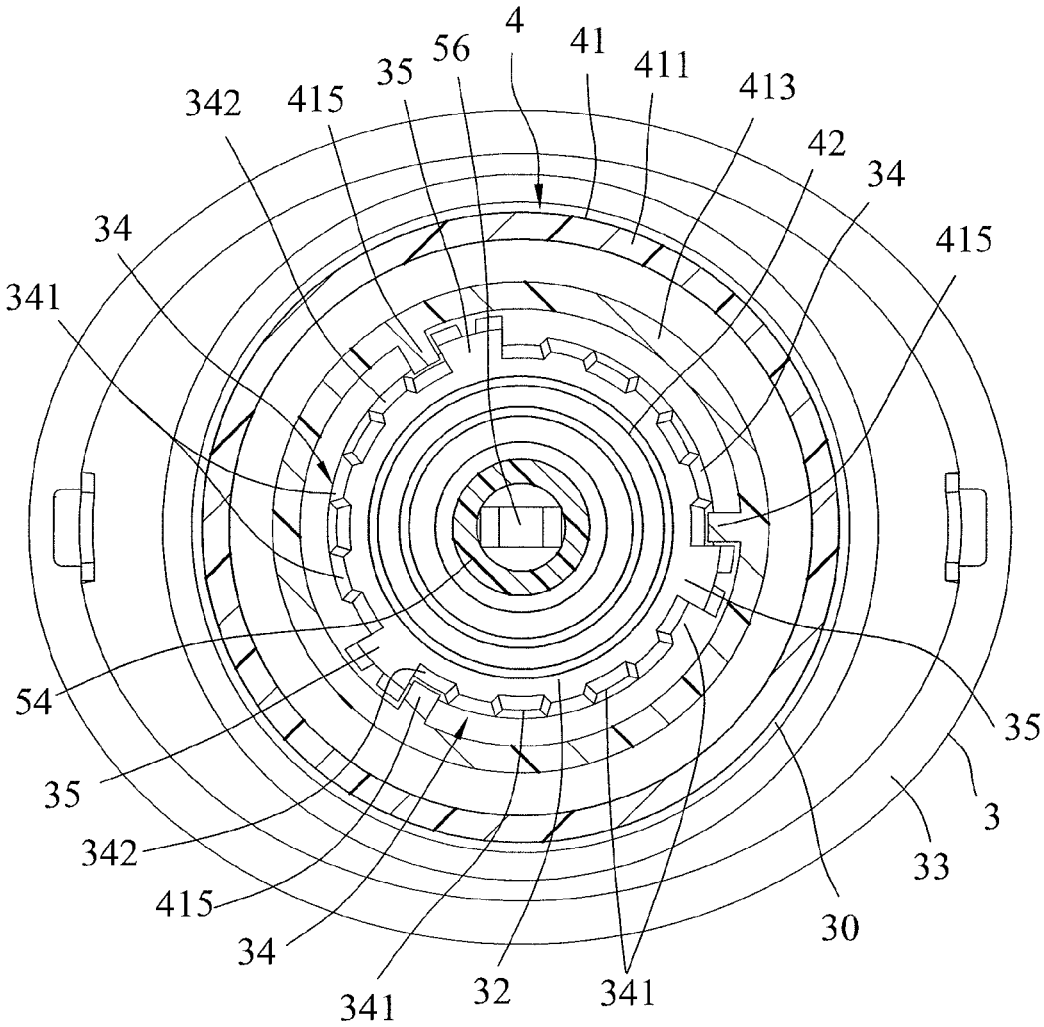
FIG. 4 is a top sectional view of the preferred embodiment for illustrating the interaction relationship between a locking connector and a depressible head assembly.
Figure 5:
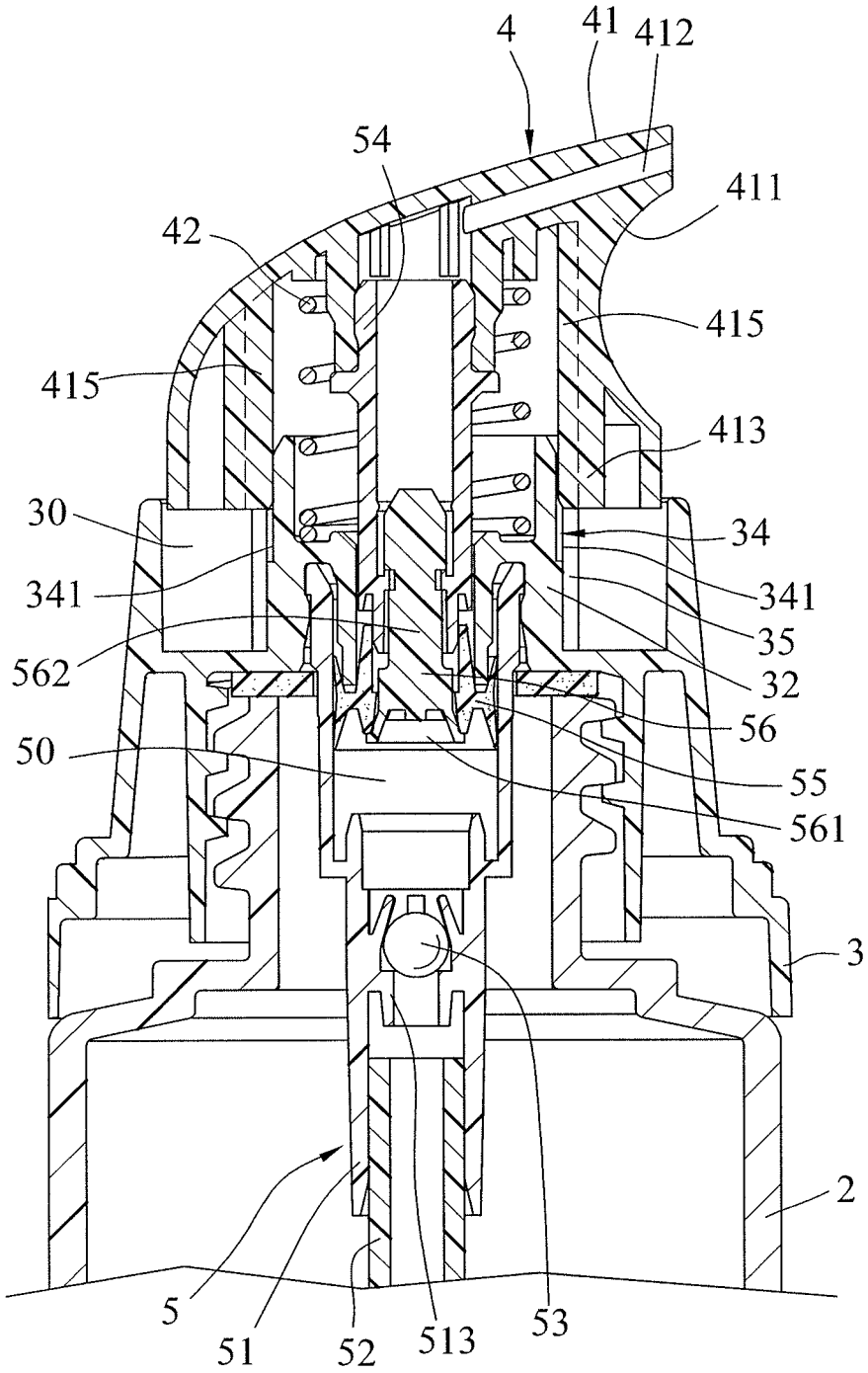
FIG. 5 is a fragmentary sectional view similar to FIG. 3 for illustrating the depressible head assembly is in a depressible position.

Referring to FIGS. 3 to 5, each of the alignment rib portions 415 is drivenable by the rotation of the depressible head body 411 to be detachedly alignable with one of the dosage guide grooves 341 and the limiting groove 342 of the respective one of the dosage guide units 34. The alignment rib portions 415 are simultaneously and respectively aligned with either of the limiting grooves 342 and the dosage guide grooves 341 that are equal in depth. Besides, the depth of insertion of each of the alignment rib portions 415 into the corresponding dosage guide unit 34 is generally the same as the depth of the limiting groove 342 and smaller than the depth of the dosage guide grooves 341. Hence, each of the alignment rib portions 415 is unable to move upwardly and downwardly in the corresponding limiting groove 342 but is movable upwardly and downwardly in the corresponding dosage guide grooves 341. Since the depths of the dosage guide grooves 341 of each dosage guide unit 34 are different, the journey of the alignment rib portions 415 in the top-bottom direction is adjustable.

The depressible head 41 is drivenable to rotate with respect to the locking connector 3 between a locked position, where the alignment rib portions 415 may abut against the dosage guide ring 32 by being respectively aligned with the limiting grooves 342 of the dosage guide units 34 so as to abut against the bottom of the limiting grooves 342 and so as to limit the depressible head 41 from being depressed downwardly, and a depressible position, where the alignment rib portions 415 are respectively aligned with the dosage guide grooves 341 of the same depth so that the depressible head 41 is depressible downwardly and so that the alignment rib portions 415 are linked to move to the bottom of the dosage guide grooves 341 to drive the pump unit 5.

Referring to FIGS. 1 and 3, the pump unit 5 includes: a tubular member 51 that is disposed in the annular engaging grove 321 of the dosage guide ring 32; a pipette 52 that is inserted in the bottom of the tubular member 51 and that extends downwardly into the container body 2; a check member 53 that is ball-shaped, movable in the top-bottom direction and mounted in the tubular member 51 and that openably closes the tubular member 51; a piston tube 54 that is disposed in the engaging ring 414 of the depressible head 41 and that is drivenable by the depressible head 41 to be movable in the top-bottom direction to be spatially communicable with the tubular member 51 through the dosage guide ring 32; a piston ring 55 that is movable in the top-bottom direction, that is air-tightly mounted in the tubular member 51 and sleeved on the piston tube 54; and a valve member 56 that extends upwardly through the piston ring 55 and that is inserted securely in the piston tube 54. The piston ring 55 is disposed above the check member 53.

The tubular member 51 includes: a large diameter portion 511 that extends upwardly through the dosage guide ring 32 and that is securely mounted in the annular engaging groove 321 of the dosage guide ring 32; a small diameter portion 512 that extends downwardly from an inner peripheral edge of the large diameter portion 511; a stopping ring 513 that extends radially and inwardly from an inner surface of the small diameter portion 512; and four resilient arm portions 514 that are spaced apart from one another, that inclinedly extend inwardly and upwardly from the inner surface of the small diameter portion 512, and that are disposed above the stopping ring 513. The check member 53 is depressible downwardly and resiliently by the resilient arm portions 514 to detachedly abut against an inner peripheral edge of the stopping ring 513 so as to close the small diameter portion 512. The resilient arm portions 514 are depressible downwardly to abut against the check member 53.

The piston tube 54 includes a rotatably engaging portion 541 extending upwardly into the engaging ring 414, an inserting portion 542 extending from a bottom of the rotatably engaging portion 541 into the piston ring 55 for being mounted thereon, and an annular engaging portion 543 extending radially and inwardly from a bottom of the rotatably engaging portion 541.

The piston ring 55 includes an outer annular portion 551 that is movable in the top-bottom direction and that air-tightly abuts against the large diameter portion 511 of the tubular member 51, and an inner annular portion 552 that is radially spaced-apart from and disposed inside of the outer annular portion 551 and that is abuttingly and air-tightly sleeved on the inserting portion 542 of the piston tube 54 and the valve member 56. The valve member 56 includes an abutting section 561 that is truncated cone-shaped and that is moveable upwardly to detachedly abut against a bottom side of the inner annular portion 552 of the piston ring 55 for sealing an opening formed on the bottom side of the inner annular portion 552 of the piston ring 55, and an inserting section 562 that is plate-shaped and that extends upwardly from the abutting section 561 and that is securely inserted into the inserting portion 542 and engaged with the annular engaging portion 543 of the piston tube 54.

When the container of this invention is in use, if it is desired to limit the depressible head 41 from being depressed, the depressible head 41 is to be rotated to the locked position so that the alignment rib portions 415 are respectively aligned with the limiting grooves 342 of the dosage guide units 34.

Figure 6:
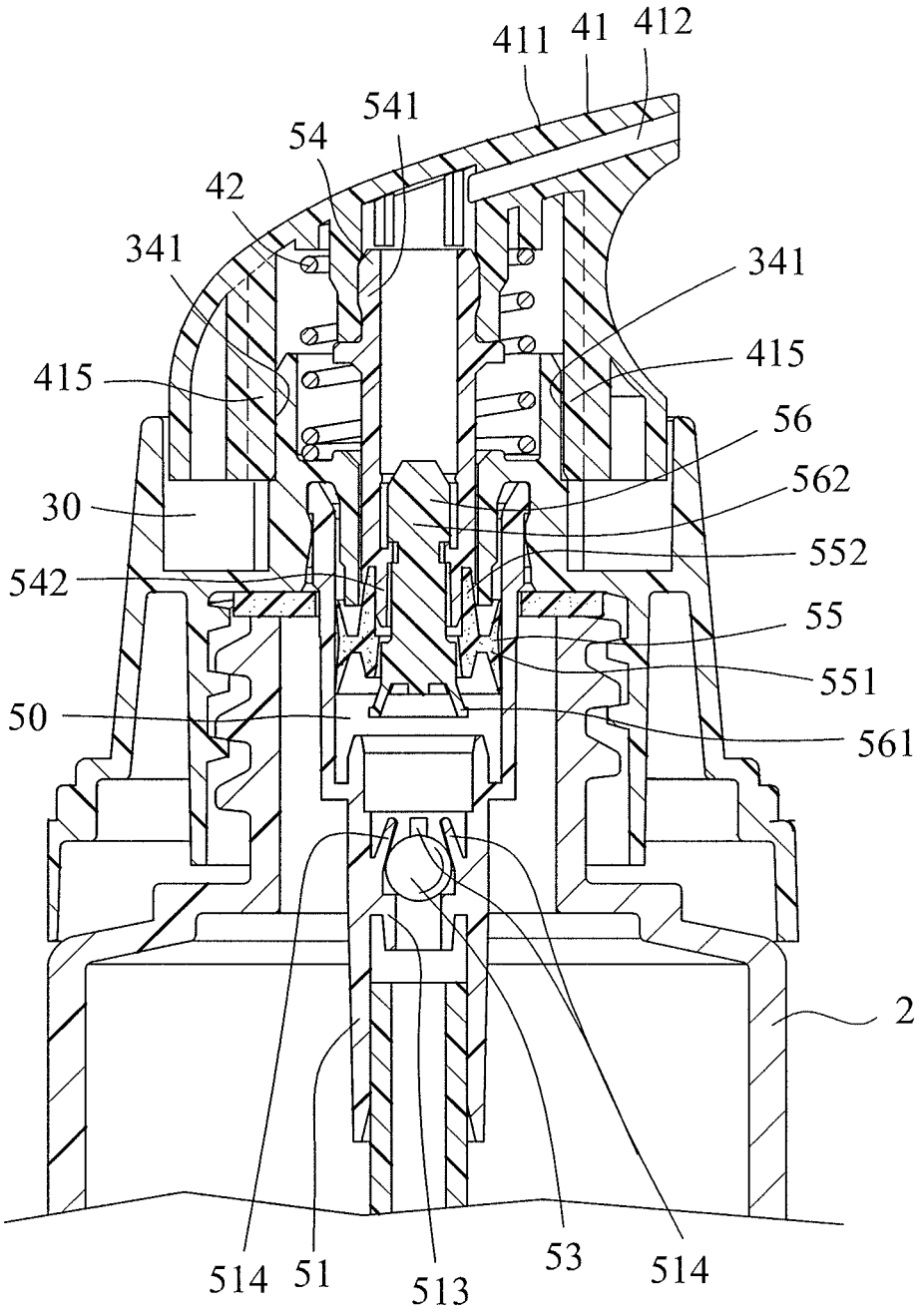
FIG. 6 is a fragmentary sectional view similar to FIG. 5 for illustrating the displacement of the depressible head assembly when being depressed down.

Referring to FIGS. 5 and 6, when it is desired to withdraw the liquid received in the container body 2, the depressible head 41 is rotated relative to the locking connector 3 to the depressible position so that each of the alignment rib portions 415 is aligned with one of the dosage guide grooves 341 of the respective one of the dosage guide units 34. Then, the depressible head 41 may be depressed downwardly to synchronously drive the pump unit 5 to withdraw the liquid. In addition, since the dosage guide grooves 341 of each of the dosage guide units 34 have different depths, the downward displacement distance of the depressible head 41 is adjustable by respectively aligning the alignment rib portions 415 with the dosage guide grooves 341 of the dosage guide units 34 having the same depth. Thus, the pump unit 5 is able to be driven by the depressible head 41 to withdraw the liquid in different amounts. The tubular member 51, the check member 53, the piston ring 55 and the valve member 56 cooperate to define a space 50.

When the pump unit 5 is driven by the depression of the depressible head 41, first the abutting section 561 of the valve member 56 is linked by the movement of the piston tube 54 to be disengaged from the piston ring 55, such that the piston tube 54 makes spatial communication with the space 50 through the piston ring 55. Next, the piston tube 54 continues to depress the piston ring 55 so that the piston ring 55 and the valve member 56 move downward together to compress the space 50 as to force the liquid drawn into the space 50 upwardly into the piston tube 54 for subsequent flowing out through the dispensing port 412 of the depressible head 41. At this time, the valve member 56 is at a first position. Through the design of aligning the alignment rib portions 415 with the dosage guide grooves 341 of the dosage guide units 34, the traveling distance of the depressible head 41 in response to a depression is adjustable and controllable, the traveling distances for the piston ring 55 and the valve member 56 are thereby adjustable and controllable to limit the compression extent of the space 50, which in turn controls the amount of the liquid to be dispensed. In the meantime, the spring 42 accumulates a restorative force as the result of compression of the depressible head 41.

Figure 7:
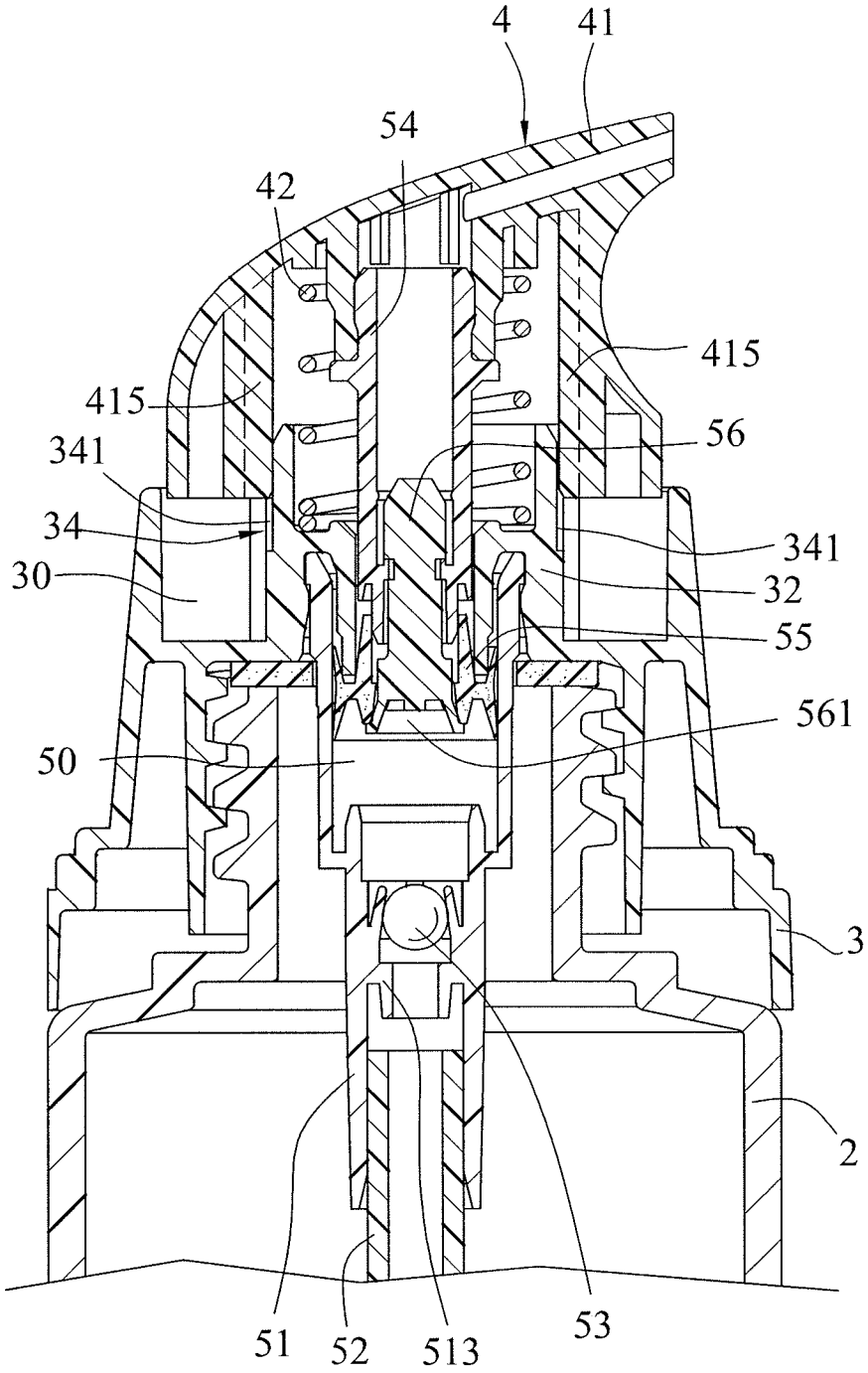
FIG. 7 is a fragmentary sectional view similar to FIG. 5 for illustrating upward movement of a check member of a pump unit when the depressible head assembly is restoratively moved upwardly.

Referring to FIG. 7, when the depressible head 41 is released, the restorative force from the spring 42 moves the depressible head 41 upwardly relative to the locking connector 3, and as a result moves the piston tube 54 upwardly relative to the locking connector 3. The piston tube 54 tends to first move the abutting section 561 of the valve member 56 upwardly to abut against the piston ring 55 air-tightly so as to break the spatial communication between the space 50 and the piston tube 54. Then, the piston tube 54 forces the valve member 56 to move upwardly to depress the piston ring 55. At this time, the valve member 56 is at a second position. During the progress, as the result of enlarging the volume of the space 50, a sucking force caused by a negative pressure is generated as to overwhelm the depressing resilient force inherent to the resilient arm portions 514, so that the check member 53 is moved upwardly as to be disengaged from the stopping ring 513 and to push upwardly the resilient arm portions 514 so that the space 50 is enabled to have spatial communication with the pipette 52 through the small diameter portion 512, and in such a manner, the liquid in the pipette 52 gradually enters the space 50 till a pressure balance is reached between the space 50 and the inside of the pipette 52, and then, the resilient arm portions 514 will again depress the check member 53 to seal the stopping ring 513 air-tightly so as to block the liquid in the space 50 from flowing down back to the pipette 52.

In this embodiment, the locking connector 3 includes three dosage guide units 34, and the depressible head 41 correspondingly includes three alignment rib portions 415. However, in actual practice, the arrangement of one dosage guide unit 34 and one alignment rib portion 415 is applicable, and the number of dosage guide grooves 341 included in each of the dosage guide units 34 is also not limited to three. Moreover, the arrangement of the limiting groove 342 is also not necessary and the length of the alignment rib portions 415 can be reduced so that the alignment rib portions 415 are disposed above the dosage guide ring 32. In such case, when the depressible head 41 is rotated to be in the locked position, the alignment rib portions 415 abut against the top surface of the dosage guide ring 32 and the depressible head 41 is limited from moving downwardly. On the other hand, when the depressible head 41 is rotated to be in the depressible position, the alignment rib portions 415 are drivenable by the depressible head 41 to be respectively aligned with the dosage guide grooves 341.

Moreover, it is noted that, in this embodiment, the structural design for withdrawing the liquid in multistage manner can be incorporated with various depressible-type pump units 5 and hence is not limited to what is disclosed herein.

Figure 8:
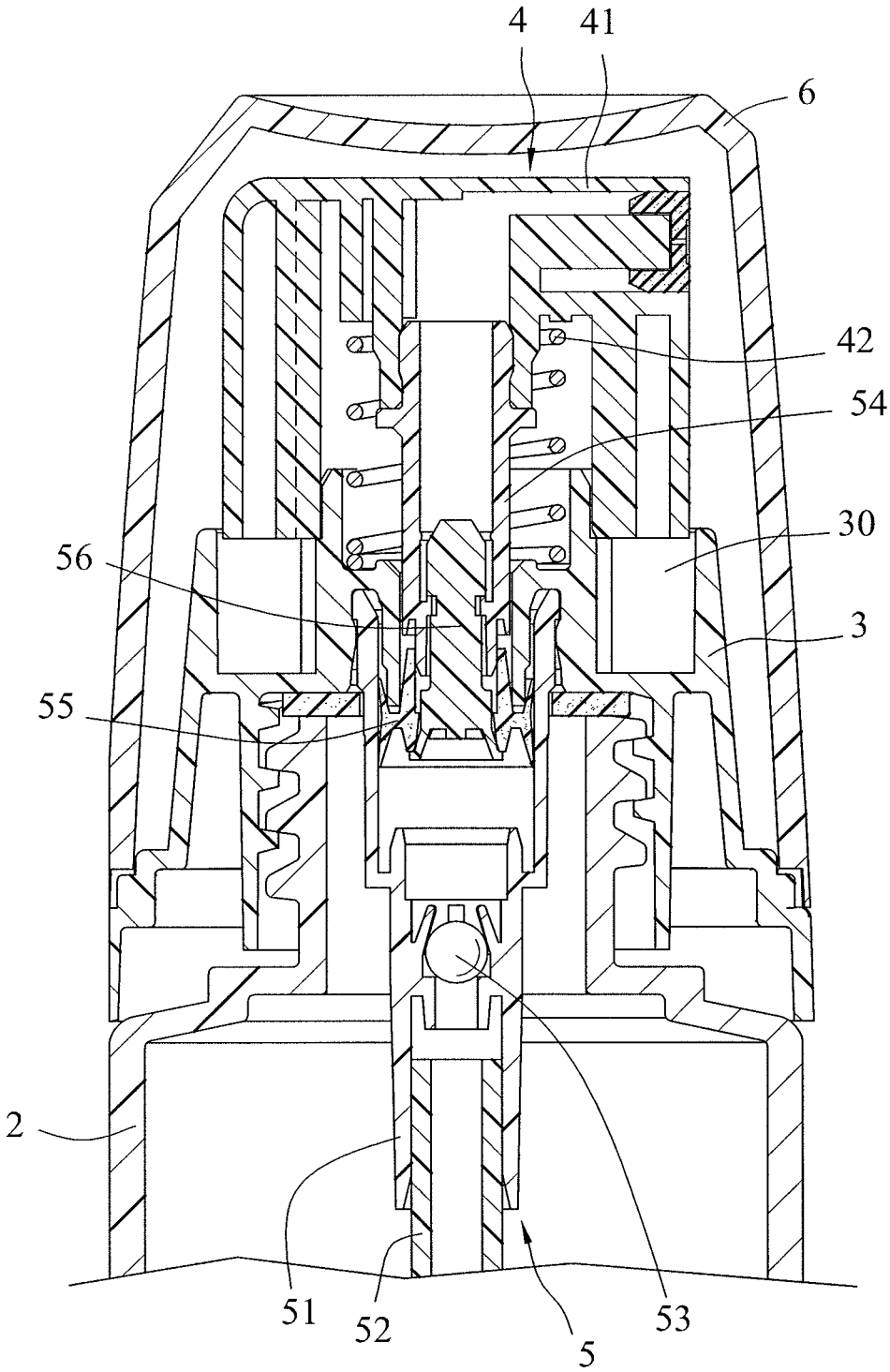
FIG. 8 is a fragmentary sectional view of another configuration of the depressible head assembly of the preferred embodiment.

In this embodiment, the depressible head 41 is designed to directly dispense the liquid in the liquid form, and however, in practice, the depressible head 41 may be designed to dispense the liquid in spray or foam form. As shown in FIG. 8, the depressible head 41 can be replaced with a spray head.

In sum, through the structural design of the combination of the locking connector 3 with the dosage guide units 34, each of which includes the limiting groove 342 and the dosage guide grooves 341 of different depths, and the alignment rib portions 415 of the depressible head assembly 4, this invention provides a container that is capable of dispensing liquid in a multistage manner and that is convenient for use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A container, comprising:

a container body for receiving a liquid;

a locking connector threadedly disposed on said container body, said locking connector including a locking ring that is threadedly disposed on a top portion of said container body, a dosage guide ring that protrudes upwardly from said locking ring, and at least one dosage guide unit that has a plurality of dosage guide grooves, which are downwardly and separately indented from a top end of said dosage guide ring to different depths in a top-bottom direction;

a pump unit extending through and mounted in said dosage guide ring, said pump unit extending downwardly into said container body and being drivenable to move in the top-bottom direction so as to draw the liquid from said container body;

a depressible head assembly including a depressible head that is disposed on said locking connector for driving said pump unit to move in the top-bottom direction, and a biasing member that is disposed between and abuts against said depressible head and said locking connector in the top-bottom direction, said depressible head being formed with a dispensing port for dispensing the liquid drawn by said pump unit and having an alignment rib portion that is movable in the top-bottom direction and that is insertable into one of said dosage guide grooves, said depressible head being drivenable to rotate with respect to said locking connector between a locked position, where said alignment rib portion abuts against said dosage guide ring so that said depressible head is limited from being depressed downwardly to an extent as to drive said pump unit, and a depressible position, where said alignment rib portion is aligned with one of said dosage guide grooves so that said depressible head is depressible downwardly to drive said pump unit;

wherein said dosage guide unit further includes a limiting groove that is indented from said top end of said dosage guide ring, said limiting groove and said dosage guide grooves being exposed outwardly of said dosage guide ring, said alignment rib portion being linked by said depressible head to rotate together therewith between the locked position, where said alignment rib portion is aligned with said limiting groove to be limited from moving downwardly to the extent as to drive said pump unit, and the depressible position, where said alignment rib portion is linked to move downwardly to be aligned with one of said dosage guide grooves as to permit said depressible head to be depressible downwardly to drive the pump unit.

2. The container of claim 1, wherein said locking connector includes a plurality of said dosage guide units indented from said top end of said dosage guide ring, said depressible head including a plurality of said alignment rib portions that extend in the top-bottom direction, each of which is alignable with one of said dosage guide grooves of a respective one of said dosage guide units, said alignment rib portions being simultaneously and respectively aligned with either of said limiting grooves and said dosage guide grooves that are equal in depth.

3. The container of claim 2, wherein said dosage guide ring further includes a plurality of spaced-apart blocking ribs protruding from said dosage guide ring and extending in the top-bottom direction, each of said blocking ribs being disposed between two adjacent ones of said dosage guide units, said alignment rib portions being respectively blocked by said blocking ribs so that the degree of rotation of said depressible head relative to said locking connector is limited.

4. The container of claim 3, wherein each of said dosage guide grooves and said limiting groove has a cross section that is perpendicular to the top-bottom direction and that is outwardly and radially diverged from said dosage guide ring.

5. The container of claim 3, wherein said pump unit includes:

a tubular member that is disposed in said dosage guide ring;

a check member that is disposed in said tubular member, that is movable in the top-bottom direction and that openably closes said tubular member;

a piston tube that is disposed in said depressible head and that is drivenable by said depressible head to be movable in the top-bottom direction to extend through said dosage guide ring and to be spatially communicable with said tubular member;

a piston ring that is movable in the top-bottom direction, that is air-tightly mounted in said tubular member and sleeved on said piston tube; and a valve member that extends upwardly through said piston ring and that is inserted securely in said piston tube;

wherein said piston ring is disposed above said check member; and wherein said tubular member, said check member, said piston ring and said valve member cooperate to define a space, said piston ring being depressible by said piston tube to move downwardly to compress said space, said valve member being driven by said piston tube to move between a first position where the valve member moves downwardly relative to said piston ring and makes said space in spatial communication with said piston tube, and a second position, where said valve member moves upwardly to air-tightly abut against said piston ring and drives synchronous upward movement of said piston tube.

6. The container of claim 5, wherein said valve member includes an abutting section that is moveable upwardly to detachedly abut against a bottom side of said piston ring for sealing an opening formed on said bottom side of said piston ring, and an inserting section that is plate-shaped and that extends upwardly from said abutting section and is securely inserted into said piston tube.

7. The container of claim 5, wherein said tubular member includes:

a large diameter portion that extends upwardly through said dosage guide ring and that is securely mounted in said dosage guide ring;

a small diameter portion that extends downwardly from an inner peripheral edge of said diameter portion;

a stopping ring that extends radially and inwardly from an inner surface of said small diameter portion; and a plurality of resilient arm portions that are spaced apart from one another, that inclinedly extend inwardly and upwardly from said inner surface of said small diameter portion, and that are disposed above said stopping ring;

wherein said check member is depressed downwardly and resiliently by said resilient arm portions to detachedly abut against an inner peripheral edge of said stopping ring.

8. The container of claim 5, wherein said locking connector further includes an outer surrounding ring that extends in the top-bottom direction from an outer peripheral edge of said locking ring, said outer surrounding ring, said dosage guide ring and said locking ring cooperating to define a mounting space that has a top opening, said depressible head further having a depressible head body that has a bottom opening, and that is depressible downwardly to move into said mounting space, an inner surrounding ring that protrudes downwardly from an inner surface of said depressible head body to be sleeved on said dosage guide ring, and an engaging ring that protrudes downwardly from said inner surface of said depressible head body and that is movably sleeved on said piston tube, said dispensing port extending through said depressible head body and being disposed in spatial communication with said engaging ring, said alignment rib portions protruding from an inner peripheral surface of said inner surrounding ring and extending in the top-bottom direction.

9. The container of claim 6, wherein said piston ring includes an outer annular portion that is movable in the top-bottom direction and that air-tightly abuts against an inner surface of said tubular member, and an inner annular portion that is radially spaced-apart from and disposed inside of said outer annular portion and that is abuttingly and air-tightly sleeved on said piston tube, said inner annular portion being depressible downwardly by said piston tube as to drive the synchronous movement of said outer annular portion, said abutting section of said valve member being moveable upwardly to airy-tightly abut against a bottom side of said inner annular portion.

10. The container of claim 1, wherein each of said dosage guide grooves and said limiting groove has a cross section that is perpendicular to the top-bottom direction and that is outwardly and radially diverged from said dosage guide ring.

11. The container of claim 1, wherein said pump unit includes:

a tubular member that is disposed in said dosage guide ring;

a check member that is disposed in said tubular member, that is movable in the top-bottom direction and that openably closes said tubular member;

a piston tube that is disposed in said depressible head and that is drivenable by said depressible head to be movable in the top-bottom direction to extend through said dosage guide ring and to be spatially communicable with said tubular member;

a piston ring that is movable in the top-bottom direction, that is air-tightly mounted in said tubular member and sleeved on said piston tube; and a valve member that extends upwardly through said piston ring and that is inserted securely in said piston tube;

wherein said piston ring is disposed above said check member; and wherein said tubular member, said check member, said piston ring and said valve member cooperate to define a space, said piston ring being depressible by said piston tube to move downwardly to compress said space, said valve member being driven by said piston tube to move between a first position where said valve member moves downwardly relative to said piston ring and makes said space in spatial communication with said piston tube, and a second position, where said valve member moves upwardly to air-tightly abut against said piston ring and drives synchronous upward movement of said piston tube.

12. The container of claim 11, wherein said valve member includes an abutting section that is moveable upwardly to detachedly abut against a bottom side of said piston ring for sealing an opening formed on said bottom side of said piston ring, and an inserting section that is plate-shaped and that extends upwardly from said abutting section and is securely inserted into said piston tube.

13. The container of claim 11, wherein said tubular member includes:

a large diameter portion that extends upwardly through said dosage guide ring and that is securely mounted in said dosage guide ring;

a small diameter portion that extends downwardly from an inner peripheral edge of said large diameter portion;

a stopping ring that extends radially and inwardly from an i e surface of said small diameter portion; and a plurality of resilient arm portions that are spaced apart from one another, that inclinedly extend inwardly and upwardly from said inner surface of said small diameter portion, and that are disposed above said stopping ring;

wherein said check member is depressed downwardly and resiliently by said resilient arm portions to detachedly abut against an inner peripheral edge of said stopping ring.

14. The container of claim 11, wherein said locking connector further includes an outer surrounding ring that extends in the top-bottom direction from an outer peripheral edge of said locking ring, said outer surrounding ring, said dosage guide ring and said locking ring cooperating to define a mounting space that has a top opening, said depressible head further having a depressible head body that has a bottom opening, and that is depressible downwardly to move into said mounting space, an inner surrounding ring that protrudes downwardly from an inner surface of said depressible head body to be sleeved on said dosage guide ring, and an engaging ring that protrudes downwardly from said inner surface of said depressible head body and that is movably sleeved on said piston tube, said dispensing port extending through said depressible head body and being disposed in spatial communication with said engaging ring, said alignment rib portions protruding from an inner peripheral surface of said inner surrounding ring and extending in the top-bottom direction.

15. The container of claim 12, wherein said piston ring includes an outer annular portion that is movable in the top-bottom direction and that air-tightly abuts against an inner surface of said tubular member, and an inner annular portion that is radially spaced-apart from and disposed inside of said outer annular portion and that is abuttingly and air-tightly sleeved on said piston tube, said inner annular portion being depressible downwardly by said piston tube as to drive the synchronous movement of said outer annular portion, said abutting section of said valve member being moveable upwardly to air-tightly abut against a bottom side of said inner annular portion.

* * * * *